US008505797B1

(12) United States Patent
Ringwood et al.

(10) Patent No.: US 8,505,797 B1
(45) Date of Patent: Aug. 13, 2013

(54) SOUND-SUPPRESSED, POWDER-ACTUATED STUD DRIVER

(75) Inventors: Terence Ringwood, Landing, NJ (US); Steve Kotefski, Bloomingdale, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 314 days.

(21) Appl. No.: 12/947,159

(22) Filed: Nov. 16, 2010

(51) Int. Cl.
*B25C 1/10* (2006.01)

(52) U.S. Cl.
USPC ..... 227/10; 89/1.14

(58) Field of Classification Search
USPC ..... 227/9–11; 89/1.14
See application file for complete search history.

(56) References Cited

U.S. PATENT DOCUMENTS 1,365,869 A * 1/1921 Temple ..... 227/9
1,984,117 A * 12/1934 Davis ..... 227/8
2,064,503 A * 12/1936 Temple, Jr. ..... 102/531
2,666,252 A * 1/1954 Temple ..... 29/432
2,869,127 A * 1/1959 Williams ..... 227/8
2,930,042 A * 3/1960 Temple et al. ..... 227/10
3,055,008 A * 9/1962 Bell et al. ..... 227/10
3,565,312 A * 2/1971 Temple et al. ..... 227/9
3,902,238 A * 9/1975 Monson ..... 29/432
4,060,188 A * 11/1977 Monson ..... 227/9
4,119,257 A * 10/1978 Combette et al. ..... 227/10
4,159,070 A * 6/1979 Monson ..... 227/10
4,252,259 A * 2/1981 Brosius ..... 227/8
4,493,376 A * 1/1985 Kopf ..... 173/210
4,505,018 A * 3/1985 Regalbuto et al. ..... 29/432
5,038,665 A * 8/1991 Aske et al. ..... 89/1.14
5,273,198 A * 12/1993 Popovich et al. ..... 227/10

* cited by examiner

*Primary Examiner* — M. Alexandra Elve
*Assistant Examiner* — Andrew M Tecco
(74) *Attorney, Agent, or Firm* — Henry S. Goldfine

(57) ABSTRACT

A sound-suppressed, powder-actuated stud driver may include a single-use cartridge assembly and a reusable handle assembly. The cartridge assembly may include a housing with a through-bore. The through-bore may include a firing pin retainer with a firing pin therein, an ammunition cartridge case adjacent the firing pin retainer, a piston at least partially disposed in the ammunition cartridge case, and a stud. The handle assembly may include a housing with one open end and a bore extending inwardly from the open end. A handle assembly firing pin may extend axially into the bore from a closed end of the housing. A pair of blocking pins may be movable into and out of the bore, for ensuring proper loading of the cartridge assembly into the bore. A spring-loaded locking pin may lock the cartridge assembly in the bore.

3 Claims, 2 Drawing Sheets

SOUND-SUPPRESSED, POWDER-ACTUATED STUD DRIVER

STATEMENT OF GOVERNMENT INTEREST

The inventions described herein may be manufactured, used and licensed by or for the U.S. Government for U.S. Government purposes.

BACKGROUND OF THE INVENTION

The invention relates in general to powder-actuated tools and in particular to sound-suppressed stud drivers.

A stud driver may be a means to drive nails or studs into various substrates, for example, masonry or wood. With the nail or stud secured in the substrate, one may attach or support objects on or to the nail or stud. In conventional stud drivers, burning propellant may drive a "hammer" or piston-like device into the stud or nail, which is then driven into the substrate. At the final extension of the stroke or cycle, the propellant may be out-gassed into the environment thereby creating a loud noise. The reason for the out-gassing may be to render the stud driver safe for reloading purposes.

In some environments, it may be desirable to reduce the noise output of the stud driver. For example, a worker may have a need to attach various payloads to surfaces without being detected. The worker may be exposed to danger if any type of sound is generated.

Past attempts to develop a sound-suppressed stud driver resulted in apparatus that were not capable of penetrating the various substrates effectively. If a sound-suppressed stud driver cannot penetrate the needed materials, then it is not effective.

SUMMARY OF THE INVENTION

It is an object of the invention to provide a sound-suppressed, powder-actuated stud driver.

One aspect of the invention is a cartridge assembly for a sound-suppressed, powder-actuated stud driver. The cartridge assembly may include a generally cylindrical housing having a through-bore. A firing pin retainer may be disposed in the through-bore and a firing pin may be disposed in the firing pin retainer. An ammunition cartridge case having a base may be disposed in the through-bore with the base adjacent the firing pin retainer. A piston may be at least partially disposed in the ammunition cartridge case. A stud may be disposed in the through-bore.

The firing pin may be spaced apart from an open end of the housing that is adjacent the firing pin retainer. The firing pin retainer may include a firing pin stop that limits movement of the firing pin in a direction away from the base of the ammunition cartridge case. The firing pin stop may seal the through-bore when the firing pin is pressed against the firing pin stop.

The cartridge assembly may include sealing material disposed beneath a head of the stud.

The through-bore may include a tapered portion that tapers from a first diameter of about an outside diameter of the ammunition cartridge case to a second diameter of about an outside diameter of the stud. Energetic material may be disposed at the base of the ammunition cartridge case.

The energetic material may be disposed in an energetic material housing that is separate from the ammunition cartridge case. After activation of the energetic material, the sealing material beneath the head of the stud may form a seal at the tapered portion of the through-bore.

Another aspect of the invention is a handle assembly for a sound-suppressed, powder-actuated stud driver. The handle assembly may include a housing with an open end and a closed end and a bore extending inwardly from the open end. A firing pin may extend axially into the bore from the closed end of the housing. A first blocking pin may be movable into and out of the bore in an area near the closed end. A second blocking pin may be movable into and out of the bore in an area between the first blocking pin and the open end of the housing. A spring-loaded locking pin may be movable into and out of the bore.

A handle lever may have one end engaged with the first blocking pin and an intermediate portion engaged with the second blocking pin.

A safety switch may be movable between unarmed and armed positions. In the unarmed position, the safety switch may prevent movement of the first blocking pin out of the bore. The safety switch may be biased to the unarmed position.

A shield may be disposed near the open end of the housing and may extend radially outward from the housing.

A firing pin support may be disposed in the closed end of the housing. At least a portion of the firing pin may be disposed in the firing pin support.

A further aspect of the invention is a sound-suppressed, powder-actuated stud driver. The stud driver may include a cartridge assembly and a handle assembly.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A sound-suppressed stud driver (SSSD) may include two primary components. The two primary components may be a cartridge assembly and a handle assembly. The cartridge assembly may be a single-use component. The handle assembly may be used multiple times. The cartridge assembly may include energetic material and a stud. Activation of the energetic material may cause the stud to penetrate a material. The stud may not completely exit the cartridge assembly. Thus, both the stud and the cartridge assembly may be fixed to the material. The cartridge assembly remains intact with the stud and provides the support that may be needed in a particular situation.

To use the SSSD, one may first load a cartridge assembly into a handle assembly. To activate the SSSD, one may push or force the end of the cartridge assembly against the material to be penetrated. Such a push or force causes movement of the cartridge assembly inside the handle assembly, which causes the energetic material to burn. The gases produced by the energetic material may drive a piston onto the stud, thereby forcing the stud into the material to be penetrated.

Figure 1:
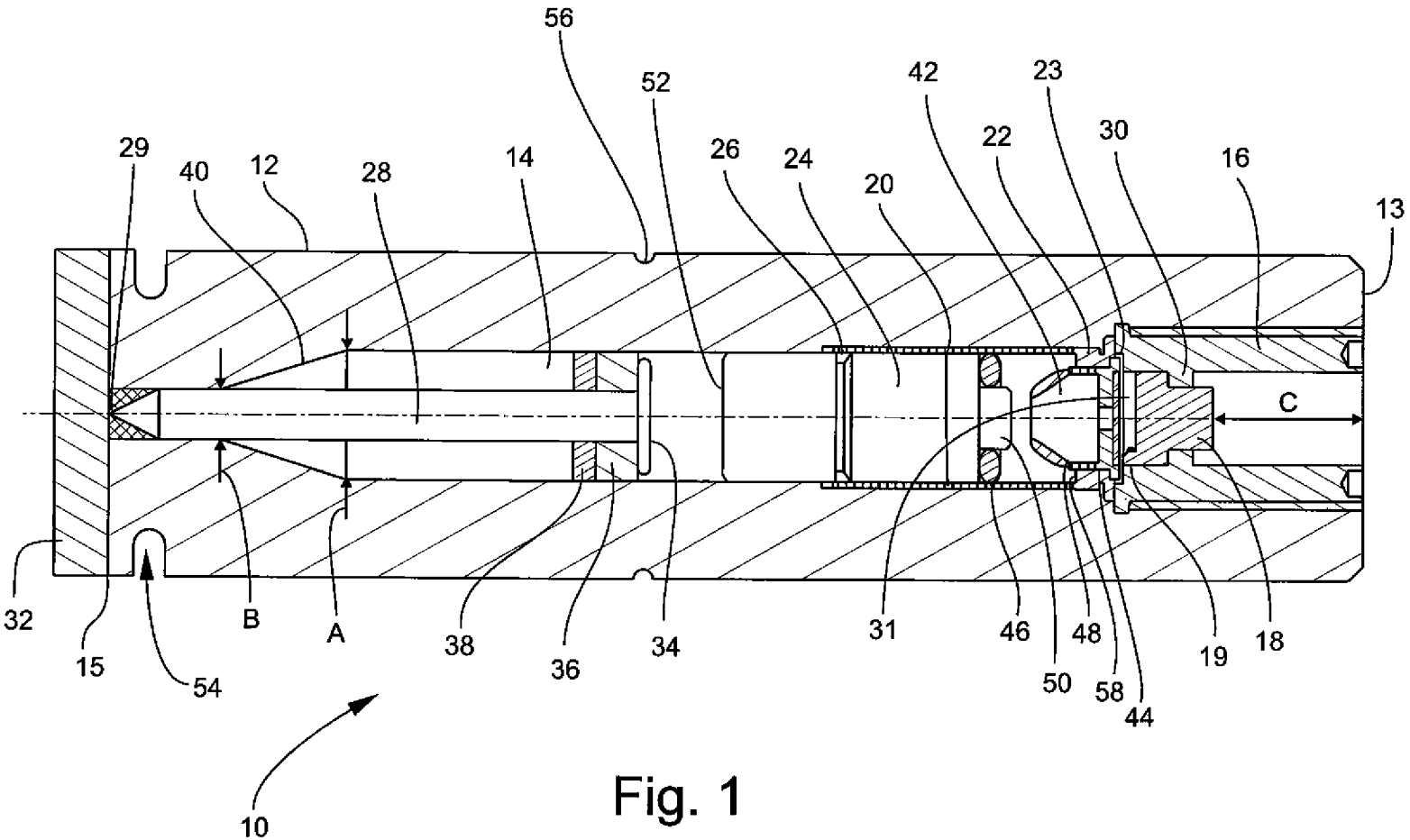
FIG. 1 is a longitudinal sectional view of an embodiment of a cartridge assembly for a sound-suppressed, powder-actuated stud driver.
Figure 2:
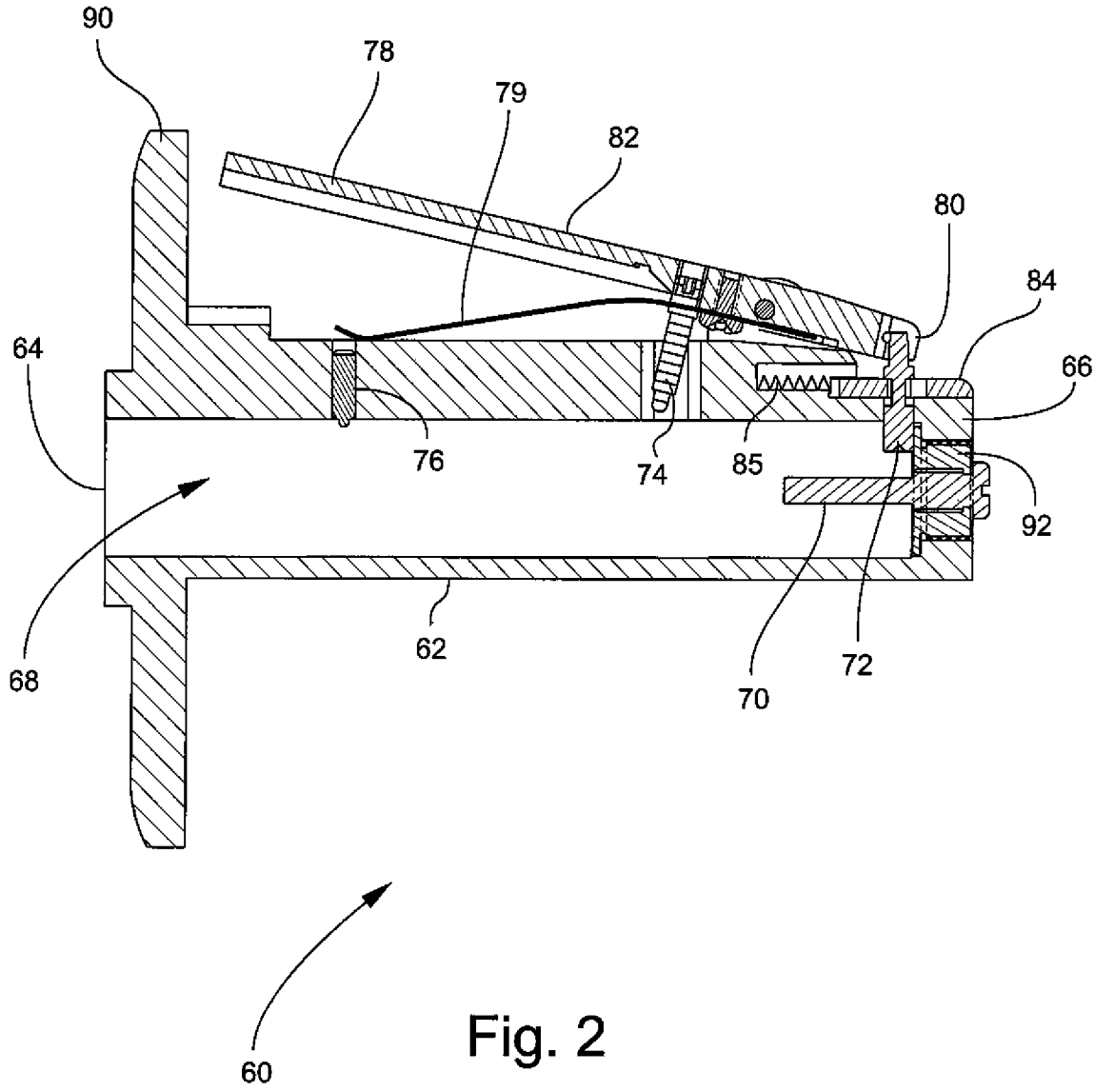
FIG. 2 is a longitudinal sectional view of an embodiment of a handle assembly for a sound-suppressed, powder-actuated stud driver.

A SSSD may include a cartridge assembly 10 (FIG. 1) and a handle assembly 60 (FIG. 2). Cartridge assembly 10 may include a generally cylindrical housing 12 having a through-bore 14. Housing 12 may retain mechanical impact forces and internal pressures within its interior. Housing 12 may be made of, for example, aluminum.

A firing pin retainer 16 may be disposed in through-bore 14. A firing pin 18 may be disposed in firing pin retainer 16. An ammunition cartridge case 20 may be disposed in through-bore 14. Cartridge case 20 may include a base 22. Base 22 may be adjacent firing pin retainer 16. A piston 24 may be at least partially disposed in ammunition cartridge case 20. A stud 28 may be disposed in through-bore 14.

Firing pin retainer 16 may be fixed to housing 12 using, for example, threads. Firing pin retainer 16 may retain cartridge case 20 within housing 12. Firing pin 18 may be set-back or recessed a distance C from an open end 13 of housing 12. Open end 13 of housing 12 may be adjacent firing pin retainer 16. By recessing cartridge assembly firing pin 18 in cartridge assembly housing 12, firing pin 18 may be protected from inadvertent impact. Inadvertent impact of cartridge assembly firing pin 18 may cause cartridge assembly 10 to initiate at undesired times.

Cartridge assembly 10 may be a single-use commodity. Thus, cartridge assembly firing pin 18 may also be a single-use commodity. Single-use firing pin 18 in cartridge assembly 10 may increase the life cycle of reusable handle assembly 60 (FIG. 2) because the stress associated with firing pin 18 is limited to cartridge assembly 10.

Firing pin retainer 16 may include a firing pin stop 30 that may limit movement of firing pin 18 in a direction away from base 22 of ammunition cartridge case 20. Firing pin stop 30 may be an annular area of reduced inner diameter on firing pin retainer 16. Firing pin stop 30 may seal through-bore 14 when firing pin 18 is pressed against firing pin stop 30. Firing pin 18 may "float" within the cavity of firing pin retainer 16. Thus, firing pin 18 may always be positioned in an ideal firing position.

As explained further below, handle assembly 60 (FIG. 2) may include its own firing pin 70. A firing pin 18 in the cartridge assembly 10 and a firing pin 70 in the handle assembly 60 may provide a dual firing pin arrangement. The dual firing pin arrangement may allow for a more precise impact of firing pin 18 onto the rim 23 (FIG. 1) of blank 44. The more precise impact may be a result of firing pin 18 being tightly guided within firing pin retainer 16. Additionally, the impact of firing pin 18 may be controlled such that firing pin projection 19 may not pierce or damage the blank 44. If blank 44 were pierced, gas may escape and create noise.

A flat portion 31 of firing pin 18 may provide a stop so that firing pin projection 19 may have limited penetration. In addition, the opposite side of firing pin 18 is restricted by firing pin retainer stop 30. Firing pin retainer stop 30 may prevent firing pin 18 from exerting excessive force onto handle assembly firing pin 70 (FIG. 2).

A pad 32 may be fixed to one end 15 of housing 12. Pad 32 may muffle or reduce the sound created by impact of cartridge assembly 10 with a surface to be penetrated. Pad 32 may be made of, for example, closed-cell foam.

Stud 28 may include a head 34. Sealing material 36, 38 may be disposed beneath head 34 of stud 28. Sealing material may include, for example, a crush washer 36 and a gasket or O-ring 38.

Through-bore 14 may include a tapered portion 40. Tapered portion 40 may taper from a first diameter A to a second diameter B. First diameter A may be about a same diameter as an outside diameter of ammunition cartridge case 20. Second diameter B may be about a same diameter as an outside diameter of stud 28.

Energetic material 42 may be disposed at base 22 of ammunition cartridge case 20. Energetic material 42 may be disposed in an energetic material housing 44 that may be separate from ammunition cartridge case 20. Energetic material 42 and energetic material housing 44 may be, for example, a commercially available .27 caliber blank. After activation of energetic material 42, sealing material 36, 38 located beneath head 34 of stud 28 may form a seal at tapered portion 40 of through-bore 14.

In the past, some stud drivers required that the energetic material be hand-loaded. Cartridge assembly 10 may use commercial off-the-shelf energetic material, for example, .27 caliber blanks. The gas generated by energetic material 42 may be substantially sealed in cartridge assembly 10. Sealing the gas in cartridge assembly 10 may reduce or eliminate undesired noise. Sealing the gas in cartridge assembly 10 may reduce energy loss and increase the velocity of stud 28. Increasing the velocity of stud 28 may allow penetration of materials that are difficult to penetrate.

Energetic material housing or blank 44 containing energetic material 42 may be seated in, for example, ammunition cartridge case 20. Ammunition cartridge case 20 may be, for example, a .357 magnum cartridge case. Base 22 of ammunition cartridge case 20 may be modified, for example, enlarged, to receive energetic blank 44. Energetic blank 44 may seal ammunition cartridge case 20 after activation of energetic material 42. A tapered portion 48 of blank 44 may peel back onto a joint 58 in ammunition cartridge case 20.

The seal created by tapered portion 48 may prevent any audible sound caused by gas escaping between blank 44 and cartridge case base 22. On the other hand, the seal created by tapered portion 44 may not be perfect and may allow gas to slowly leak through over time. The small leakage rate may not adversely affect the gas pressure applied to piston 24.

At joint 58 of cartridge case 20, the combination of the thickness of energetic material housing 44 and the thickness of base 22 of cartridge case 20 may provide a strong joint that allows a larger energetic material output prior to failure.

Gas generated by energetic material 42 may force piston 24 to move to the left, as oriented in FIG. 1. Piston 24 may include ends 50 and 52. A gasket or O-ring 46 may provide a seal at end 50 of piston 24. Cartridge case 20 may form a crimp 26 with piston 24. As piston 24 moves, end 52 of piston 24 may contact head 34 of stud 28 and move stud 28 to the left, as oriented in FIG. 1. Stud 28 may move until sealing material 36, 38 and head 34 are seated in tapered portion 40 of through-bore 14. Sharpened end 29 of stud 28 may penetrate pad 32 and enter the adjacent material surface.

The outer circumference of housing 12 may include a groove 54. Groove 54 may be used to attach a line or cord (not shown) to cartridge assembly 10. The line or cord may be used to support a load after stud 28 has penetrated the substrate of interest.

Turning now to FIG. 2, handle assembly 60 for an SSSD may include a housing 62. Housing 62 may have an open end 64 and a closed end 66. A bore 68 may extend inwardly from open end 64 of housing 62. The SSSD may be "loaded" by inserting end 13 (FIG. 1) of cartridge assembly 10 into open end 64 of handle assembly 60.

A handle assembly firing pin 70 may extend axially into bore 68 from closed end 66 of housing 62. A first blocking pin 72 may be movable into and out of bore 68 in an area near closed end 66. A second blocking pin 74 may be movable into and out of bore 68 in an area between first blocking pin 72 and open end 64 of housing 62. A spring-loaded locking pin 76 may be movable into and out of bore 68.

Handle assembly 60 may include an ambidextrous safety switch 84. Safety switch 84 may be connected to first blocking pin 72. First blocking pin 72 may block cartridge assembly 10 from impacting handle assembly firing pin 70. Safety switch 84 may have armed and unarmed positions. Safety switch 84 may be in the unarmed position shown in FIG. 2. In the unarmed position, safety switch 84 may prevent movement of first blocking pin 72 out of bore 68. In the armed position, safety switch 84 may allow movement of first blocking pin 72 out of bore 68. Safety switch 84 may be biased to the unarmed position by, for example, a spring 85. In the unarmed position of safety switch 84, cartridge assembly 10 may not contact handle assembly firing pin 70.

A shield 90 may be disposed near open end 64 of bore 68. Shield 90 may extend radially outward from housing 62. Shield 90 may extend circumferentially 360 degrees. Shield 90 may protect a user's hand. Shield 90 may block fragments that may be generated when stud 28 (FIG. 1) penetrates a substrate. Shield 90 may provide equivalent protection for both right and left-handed individuals.

Handle assembly 60 may include a handle lever 78. One end 80 of handle lever 78 may be engaged with first blocking pin 72. Handle lever 78 may be depressed to raise first blocking pin 72 out of bore 68. Raising first blocking pin 72 may arm the SSSD. Handle lever 78 may be biased upwardly, as shown in FIG. 2, by a spring 79.

An intermediate portion 82 of handle lever 78 may be engaged with second blocking pin 74. Second blocking pin 74 may prevent a user from arming the SSSD even with first blocking pin 72 raised. The length of second blocking pin 74 is such that insertion of cartridge assembly 10 may be blocked by pin 74, if a user has depressed handle lever 78 before cartridge assembly 10 is inserted in bore 68 in handle assembly 60. But, cartridge assembly 10 may be inserted in bore 68 until end 13 (FIG. 1) of cartridge assembly 10 contacts first blocking pin 72, if handle lever 78 is not depressed.

Proper insertion of cartridge assembly 10 in bore 68 may be confirmed by spring-loaded locking pin 76. Spring-loaded locking pin 76 may lock into circumferential groove 56 (FIG. 1) in cartridge assembly housing 12 when cartridge assembly 10 is properly positioned in bore 68. If locking pin 76 is not engaged with groove 56, then cartridge assembly 10 may be able to slide out of bore 68. Movement of cartridge assembly 10 out of bore 68 may indicate to the user that cartridge assembly 10 is not properly inserted in bore 68.

After locking pin 76 is engaged with groove 56, a user may activate or fire the SSSD. Placing the bottom of handle assembly housing 62 in the palm of one's hand, one's fingers may rest on top of handle lever 78 and one's thumb may be positioned at safety switch 84. Safety switch 84 may be moved to the armed position (to the left in FIG. 2), so that it no longer blocks movement of first blocking pin 72. Then, handle lever 78 may be depressed, thereby raising first blocking pin 72 out of bore 68. Then, a user may strike pad 32 (FIG. 1) against the surface to be penetrated. The force on pad 32 may move cartridge assembly 10 towards handle assembly firing pin 70. Handle assembly firing pin 70 may contact and move cartridge assembly firing pin 18 towards blank 44. Firing pin projection 19 may contact rim 23 of blank 44, thereby activating energetic material 42. Gases produced by energetic material 42 may cause piston 24 to collide with stud 28 and force stud 28 into the substrate of interest.

Handle assembly 60 (FIG. 2) may include a firing pin support 92. Firing pin support 92 may be disposed in closed end 66 of housing 62. At least a portion of firing pin 70 may be disposed in firing pin support 92. Firing pin support 92 may be useful if handle assembly 60 is made of a low strength material, for example, injection-molded plastic. Firing pin support 92 may provide additional strength to handle assembly firing pin 70. Firing pin support 92 may create a larger surface area for the distribution of impact energy when cartridge assembly 10 is detonated. Firing pin support 92 may act as a strength member and, also, as a safety device. Firing pin support 92 may prevent handle assembly firing pin 70 from becoming a projectile when cartridge assembly 10 is detonated. Firing pin support 92 may be, for example, integral with firing pin 70, or, as another example, firing pin 70 may be threaded into firing pin support 92.

Handle assembly firing pin 70 may not degrade upon activation of the SSSD. The force of energetic material 42 may be directed at cartridge assembly firing pin 18, which may be a single-use component. By transferring the damaging effects away from handle assembly 60 to cartridge assembly 10, the useful life of handle assembly 60 may be increased.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A handle assembly for a sound-suppressed, powder-actuated stud driver, comprising:

a housing with an open end and a closed end and a bore extending inwardly from the open end;

a firing pin extending axially into the bore from the closed end of the housing;

a first blocking pin movable into and out of the bore in an area near the closed end;

a second blocking pin movable into and out of the bore in an area between the first blocking pin and the open end of the housing;

a spring-loaded locking pin movable into and out of the bore;

a handle lever having one end engaged with the first blocking pin and an intermediate portion engaged with the second blocking pin; and a safety switch movable between unarmed and armed positions wherein in the unarmed position the safety switch prevents movement of the first blocking pin out of the bore.

2. The handle assembly of claim 1, wherein the safety switch is biased to the unarmed position.

3. The handle assembly of claim 2, further comprising a firing pin support disposed in the closed end of the housing, at least a portion of the firing pin being disposed in the firing pin support.

* * * * *